US005897117A

United States Patent [19]

Wei

[11] Patent Number: 5,897,117

[45] **Date of Patent: *Apr. 27, 1999**

[54] 8-BALL RELAXER

[76] Inventor: Ren Rong Wei, 7611-J Rickenbacker Dr., Gaithersburg, Md. 20879

[ * ] Notice: Under 35 U.S.C. 154(b), the term of this patent shall be extended for 660 days.

[21] Appl. No.: 08/538,419

[22] Filed: Oct. 2, 1995

[51] Int. Cl.[6] ..... A63B 43/00

[52] U.S. Cl. ..... 473/571

[58] Field of Search ..... 273/58 R, 58 A, 273/58 B, 58 BA, 58 E, 58 F, 58 J, 58 K, DIG. 20; 40/327; D21/204, 205

[56] References Cited

U.S. PATENT DOCUMENTS

| | | | |
|---|---|---|---|
| 254,768 | 3/1882 | Haynes | 273/58 E |
| 690,861 | 1/1902 | Hoyt | 40/327 |
| 695,153 | 3/1902 | Hoyt | 273/58 R |
| 724,470 | 4/1903 | Haskell | 40/327 |
| 797,654 | 8/1905 | Wingfield | 273/58 A |
| 1,286,657 | 12/1918 | Lambert | 40/327 |
| 1,789,333 | 1/1931 | Da Costa | 273/58 E |
| 2,003,957 | 6/1935 | Salisbury | 273/58 E |
| 2,499,483 | 3/1950 | Foy | 273/58 E |
| 2,784,526 | 3/1957 | Bounadere | 273/58 E |
| 3,228,686 | 1/1966 | Faulkner, 3rd | 40/327 |

OTHER PUBLICATIONS

"Mystery '8' Ball", 2E–510, Jan. 1972.

*Primary Examiner*—Steven Wong

[57] ABSTRACT

A relaxing device in the form of a hard, hollow ball with a smooth hard coating decorated with a number of figure 8s to simulate the 8-ball in pocket billiards. A bell is mounted within the ball. Manipulation of the ball produces pleasant sensations of feel, sight, and sound.

6 Claims, 1 Drawing Sheet

8-BALL RELAXER

BACKGROUND OF THE INVENTION

This invention relates to an amusement device which can serve as an aid in promoting relaxation. There are a number of activities, usually performed in a sedentary position at a desk, that humans engage in to relieve minor stress and tension. Some examples are (1) tapping on a pad with a pencil (2) stretching a rubber band between the thumbs to hear and feel the low frequency vibrations (3) doodling on a scratch pad (4) twisting paper clips (5) manually squeezing malleable objects, among many others.

The present invention belongs to this kind of activity and comprises a hard smooth ball with a decorative coating simulating the 8-ball in the game of pocket billiards. The ball is smaller than a billiard ball and is of a size to be held in the palm of the hand.

A number of balls have been invented which are distantly related to applicant's invention U.S. Pat. No. 1,286,657 issued Dec. 3, 1918 to J. P. Lambert shows a billiard ball with six symmetrically placed numerals on the surface. U.S. Pat. No. 2,003,957 issued Jun. 4, 1935 to M. B. Salisbury shows a hard rubber ball with a sounding device mounted within the interior. A plug is permanently mounted on the ball after the sounding device is inserted within the hollow of the ball.

While the above patents teach isolated features of the invention, the prior art does not teach a simulated 8-ball with a sounding device mounted in the interior.

SUMMARY OF THE INVENTION

The overall object of the invention is to provide an amusement device which promotes relaxation. A smooth hard ball with six figure 8s symmetrically placed on the surface is provided with an interior sounding device. When manipulated in the hand, the device produces pleasant sensations of feel, sight and sound.

It is another object the invention to provide the surface of a hollow hard ball with figure 8 indicia spaced on the surface to dispel the notion of "being behind the eight ball".

It is yet another object of the invention to provide the interior of a hard hollow ball with various sounding devices.

It is a specific object of the invention to provide a hard hollow ball with a removable panel to gain access to the interior.

DESCRIPTION OF THE PREFERRED EMBODIMENT

Figure 1:
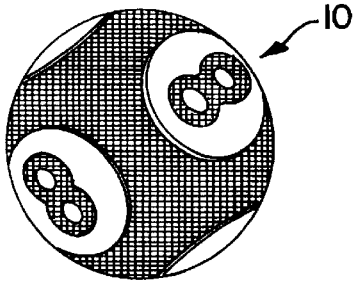
FIG. 1 is perspective view of the 8-ball relaxer.
Figure 2:
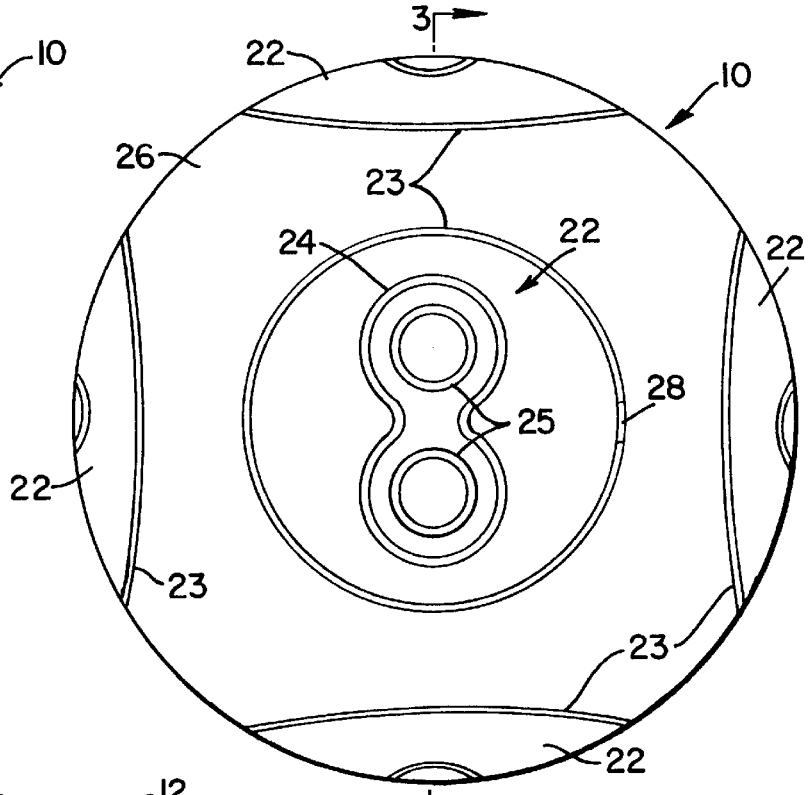
FIG. 2 is an elevation view thereof.
Figure 3:
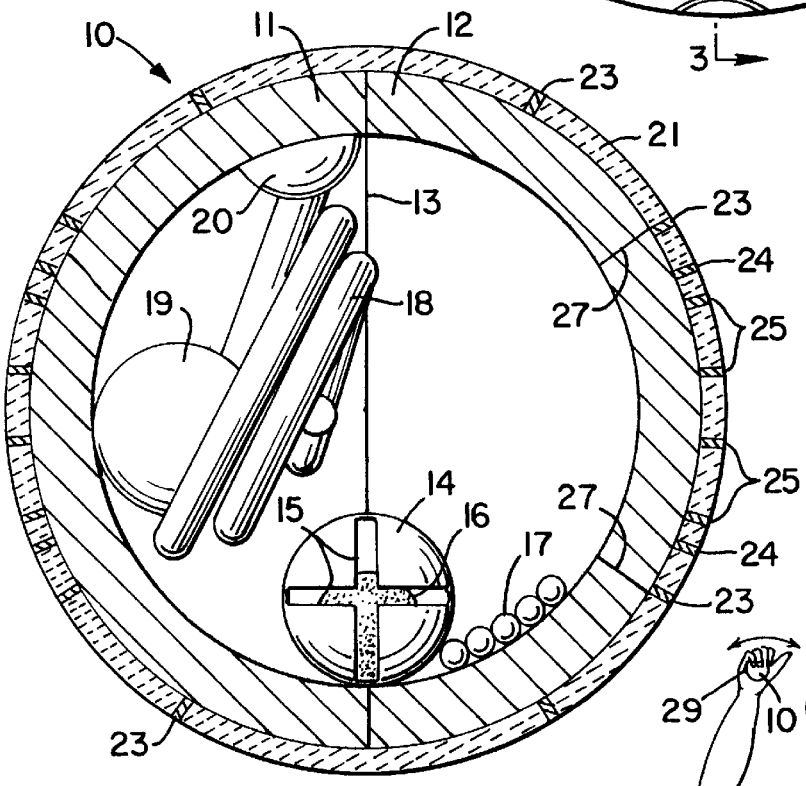
FIG. 3 is a cross-section taken along lines 3—3 of FIG. 2.

Referring now in general to the drawings and in particular to FIGS. 1–3, a pictorial view of the 8-ball relaxer is shown at 10 in FIG. 1, and an enlarged elevation view is shown in FIG. 2. The 8-ball relaxer resembles a conventional hard billiard ball with the exception that it is hollow. It has a diameter of about one and one half inches so as to be easily held in the palm of the hand.

The ball 10 is formed of two hemispherical halves 11 and 12 fused together along a parting line 13 to form the rigid, hollow, round ball. The wall thickness of the halves 11 and 12 is not critical but is preferred to be in the range of one eighth-one quarter inch. Any material having the requisite strength and hardness such as tough plastic, aluminum, steel or iron may be used in the construction of halves 11 and 12. Iron has been found to be the preferred material of construction. It has the desirable weight, sounding properties, and a surface receptive to coating as will later be described.

Prior to fusing the two halves 11 and 12 together, a bell or sounding device is placed within the interior to be sealed within. A sounding device in the form of a conventional bell 14 is shown within ball 10 to be freely rotatable therein. Bell 14 is of a type used on animal collars and is provided with a series of arcuate slots 15 to trap a sounding ball 16 within the interior. Movement of ball 10 causes rolling motion of bell 14 which emits a sound transmitted through walls 11 and 12.

The sounding device may also comprise some small steel pellets 17 which can rattle around the interior of ball 10.

A third example of a sounding device is a coiled spring 18 rigidly attached to an interior hemisphere as at 20 to trap a spring sounding ball 19. Although three separate sounding devices are shown in FIG. 3 for explanation purposes it should be clearly understood that the type and number of sounding elements mounted within ball 10 are a matter of choice depending upon the desires of the user.

The outer surface of the sphere formed by fused sections 11 and 12 is provided with a smooth decorative hard surface 21. This surface may be a glazed surface fired on an iron sphere at elevated temperatures or it may be a hard plastic coating formed on a metal or plastic sphere at lower temperatures.

An important aspect of the invention is the provision of six figure 8 sections 22 spaced at 90 degree intervals of arc as part of the decorative surface 21. FIG. 2 shows 5 arcuately spaced figure 8 sections with the sixth one (not visible) located behind the front figure 8.

Each figure 8 section comprises an outer defining ring preform 23 which may be made of copper or any other suitable material to define a distinct area within surface 21. Symmetrically placed within the confines of ring 23 is a preform 24 defining the outer shape of a figure 8. The preform 24 is formed of the same material as ring 23. Symmetrically placed within the upper and lower portions of figure 8 preform 24 are top and bottom circular preforms 25 defining the openings for the figure 8 outlined by preform 24. Preforms 25 are formed of the same material as preforms 23 and 24.

To simulate the 8-ball in the game of pocket billiards, the areas within preforms 25 and the areas between preform 24 and preform 23 are made white while the area between preforms 25 and 24 is made black.

All six figure 8 sections 22 are similarly colored. All the sections 22 are surrounded by a background section 26 shown in FIG. 2. Section 26 is colored black as shown in FIG. 1 along with the overall color scheme of 8-ball relaxer 10.

An optional feature of the invention is shown in FIG. 3 where one of the figure 8 sections 22 and its supporting section carved out of hemispherical half 12 is made removable. The removable section is provided with a bevelled edge 27 matching a corresponding bevelled edge around the opening in hemispherical half 12 to be received therein with a press fit. To remove the section 22, a small slot 28 shown in FIG. 2 is provided on an edge portion of section 22. By inserting a prying tool such as the tip of a knife blade, the section 22 can be pried loose to expose the interior of ball 10.

With the interior of the ball exposed, the sounding device may be changed as desired. Section 22 can then be pressed back into bevelled edge 27.

Figure 4:
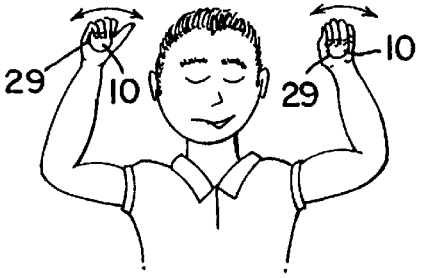
FIG. 4 is a view of a person utilizing the invention.

FIG. 4 shows a pair of 8-ball relaxers held in the palm 29 of each hand and manipulated to illustrate one mode of use for the device

What is claimed is:

1. A relaxing device comprising a hard, hollow, spherical ball of a size to be completely encircled and gripped in the palm of the hand of a user, said ball having a relatively thin walled rigid shell to resist any deformation in its normal range of use of being gripped in the palm of the hand, a smooth, hard, decorative coating on the outer surface of the shell, said decorative coating including the figure 8 at a plurality of spaced locations around the sphere; and a sounding device located within the sphere whereby manipulation of said spherical ball in the hand of the user yields pleasing sensations of feel, sight and sound.

2. The apparatus as claimed in claim 1 wherein said decorative coating includes six figure 8s symmetrically spaced around the sphere at 90 degree intervals of arc.

3. The apparatus as claimed in claim 1 wherein each figure 8 comprises a ring preform (23) encircling a distinct area in said decorative coating, a figure 8 preform (24) symmetrically placed within said ring preform; and top and bottom circular preforms (25) placed within the figure 8 preform.

4. The apparatus as claimed in claim 3 wherein the area between said ring preform and said figure 8 preform and the area enclosed by said circular preforms are white with the remaining portions of said decorative coating being black.

5. The apparatus as claimed in claim 4 wherein said preforms are made of copper.

6. The apparatus of claim 5 wherein one of said figure 8s defined by its respective ring preform is a figure 8 unit press fitted in a matching opening in said shell whereby said figure 8 unit may be removed to gain access into the interior of said spherical ball.

* * * * *